United States Patent [19]

O'Rafferty et al.

[11] 4,251,016

[45] Feb. 17, 1981

[54] STRINGED INSTRUMENT HARNESS

[76] Inventors: James O'Rafferty; Corna O'Rafferty, both of 9122 Sabre La., Westminster, Calif. 92683

[21] Appl. No.: 45,322

[22] Filed: Jun. 4, 1979

[51] Int. Cl.[3] ..... G10D 3/00

[52] U.S. Cl. ..... 224/250; 84/327; 224/49; 224/910

[58] Field of Search ..... 224/149, 150, 148, 58, 224/250, 252, 254, 49, 45 P, 184, 255, 257, 258, 271, 910, 913; 294/74; 84/327

[56] References Cited

U.S. PATENT DOCUMENTS

| | | | |
|---|---|---|---|
| 1,082,017 | 12/1913 | Feinen | 224/55 |
| 1,201,523 | 10/1916 | Stafford | 224/250 X |
| 1,208,728 | 12/1916 | Bartlett et al. | 224/148 |
| 2,643,039 | 6/1953 | Sottile | 224/250 |
| 3,172,586 | 3/1965 | Lu | 224/55 |
| 4,037,815 | 7/1977 | Delano | 84/327 X |

FOREIGN PATENT DOCUMENTS

| | | | |
|---|---|---|---|
| 1492857 | 8/1967 | France | 224/49 |

*Primary Examiner*—David A. Scherbel
*Assistant Examiner*—Jerold M. Forsberg

[57] ABSTRACT

A stringed instrument harness of flexible material having a fixed retaining member located near the fret handle and provided with four straps that criss-cross the musical instrument at the narrowest point of the instrument body. The straps cross the top and body of the instrument and are positioned on the sides with a semi-rigid crossover member through which the straps penetrate and are held in place. The straps terminate on the end opposite the retaining member with a rectangular connecting member containing adjustable fastening means to accept the straps. The harness is attached to an adjustable neck strap by means of hook type hardware located on each end to the fixed retainer and connecting member.

In another embodiment the neck strap is attached on both ends to one of the crossover members in the middle of the instrument.

6 Claims, 15 Drawing Figures

STRINGED INSTRUMENT HARNESS

BACKGROUND OF THE INVENTION

1. Field of the Invention

This invention relates generally to harnesses and more specifically to straps and carrying harnesses for stringed musical instruments.

2. Description of Prior Art

Neck and shoulder straps for carrying and supporting stringed instruments such as guitars have been in use for some time. Heretofore the straps have been attached to the instrument with objects already provided by the manufacturer such as resilient cushion bumpers primarily designed to support the instrument while resting on the floor. With this method of affixing the strap is attached on one end to the bumper and on the other tied to the fret handle between the peg box and the finger board. This procedure is basically secure but provides an unnecessarily long span between the attaching points. Other methods of attaching require a fastener either adhesively bonded or affixed with threaded inserts into the instrument itself. This method may detract from the musical qualities of the instrument by penetrating the sound box or at least decrease the value of the instrument by this retrofit. As prior art has not provided a device that does not require modification of the instrument and has aesthetic value in the form of a harness the present invention is directed to this end.

SUMMARY OF THE INVENTION

The need has existed for a strapping arrangement for a musical instrument such as a guitar that offers a high level of security and convenience without permanently modifying or adding appertinences. With this in mind the primary object of the invention provides an attaching harness that completely and tightly encloses the instrument. This is accomplished with a series of flexible straps that are positioned in such a manner as to provide attaching points at the appropriate locations on the surface of the instrument. The straps provide sufficient structural integrity to safely distribute forces throughout a large area and yet do not penetrate the basic instrument in any way.

An important object provides a strap of flexible material that is positioned around the musician's neck and is attached on both ends to the harness on the instrument completing a strong and durable strapping arrangement.

Another object is to provide a system that is completely adjustable in configuration so as to accept almost any and all sizes of guitars and like stringed musical instruments. The harness arrangements attaches on the end of a crossover strap making adjustment easy with any surplus length easily removed after installation. A connecting retainer that positions the strap crossover geometry is also completely adjustable as it may be located on any conventional width instrument and the lateral adjustment is variable between the top and bottom retainers.

Still another object provides complete adjustment of the length of the neck strap to allow the guitar to accommodate the musician and place the instrument in the most convenient location for playing.

Yet another object allows the neck loop to be attached on the top and bottom of the sounding board or in another embodiment fastens together in the middle to allow complete flexibility of movement with the instrument while playing.

A further object provides a device that enhances the aesthetic value of the instrument by adding decorative color and design in geometrical array and also allows indica to be placed thereon in the form of the owners name or group identification or the like.

These and other objects and advantages of the present invention will become apparent from the subsequent detailed description of the preferred embodiment and the appended claims taken in conjunction with the accompanying drawings.

DESCRIPTION OF THE PREFERRED EMBODIMENT

Figure 5:
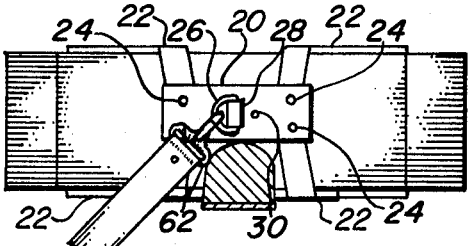
FIG. 5 is an end view taken along lines 5—5 of FIG. 1.

Referring now in detail to the referenced characters of the drawings the invention in the preferred embodiment utilizes a rectangular shape fixed retainer 20, best depicted in FIG. 5. This retainer is of a semi-rigid material to which four flexible straps 22 are attached in the proximity of the corners. The fixed retainer 20 is preferably fabricated of leather or imitation leather of plastic compositions such as vinyl impregnated cloth but also may be of any suitable semi-rigid thermoplastic substance including polystryenes and linear polyethylenes, acrylics, polycarbonates or ionmers and the like. The straps 22 are attached in the corners with fastenings means 24 such as stitching with thread, adhesive bonding, however riveting is preferred.

Figure 1:
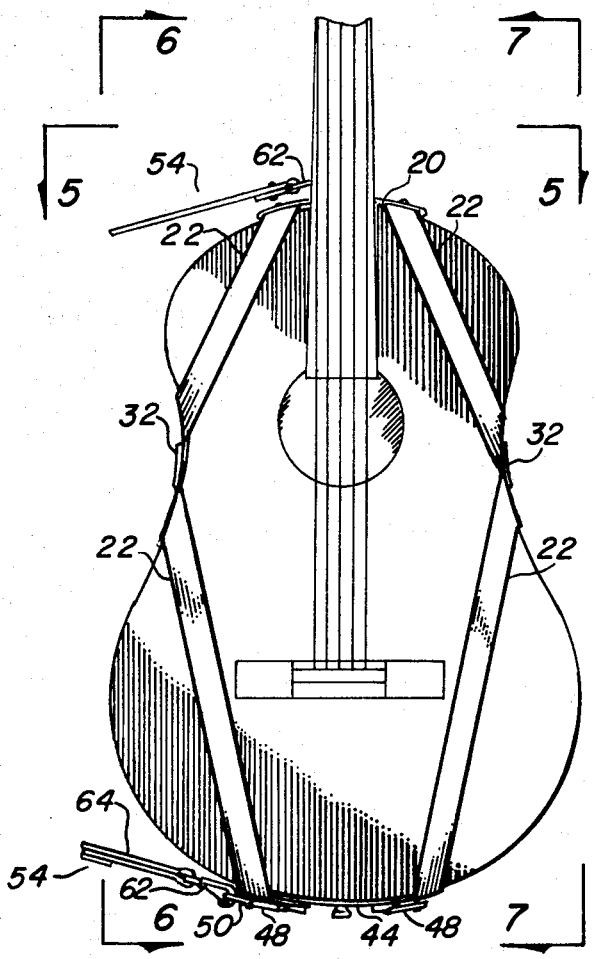
FIG. 1 is a partial plan view of the top of the stringed musical instrument with the invention fastened thereon.
Figure 2:
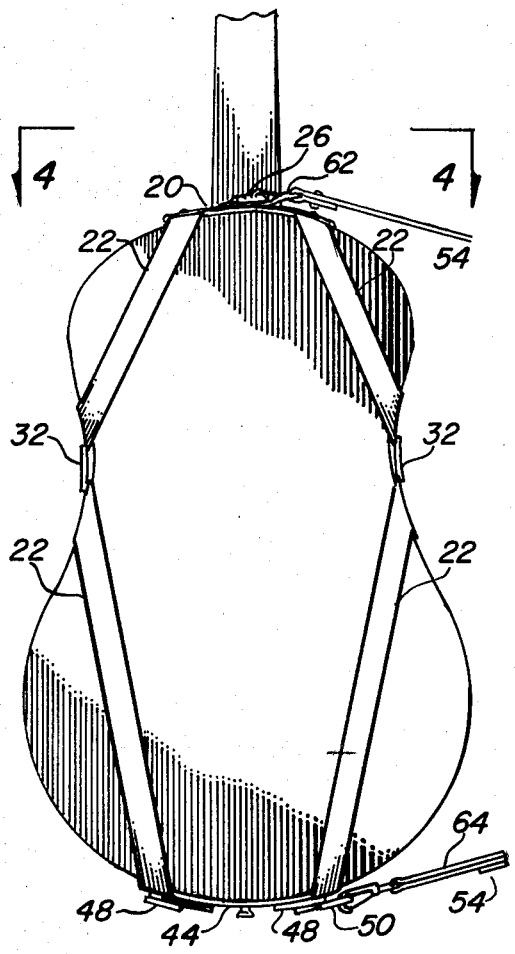
FIG. 2 is a partial plan view of the bottom of a stringed musical instrument with the invention fastened thereto.
Figure 4:
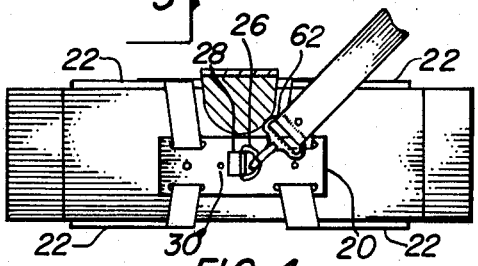
FIG. 4 is a partial view of the end of the invention in a side loop taken along lines 4—4 of FIG. 2.
Figure 6:
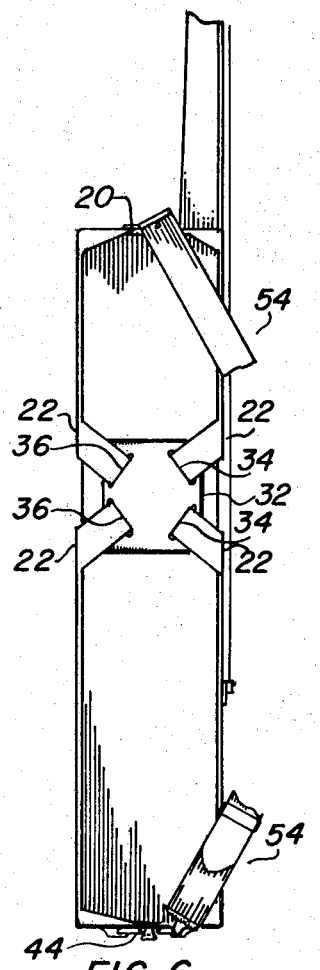
FIG. 6 is a view of the side of the instrument and invention taken along line 6—6 of FIG. 1.
Figure 7:
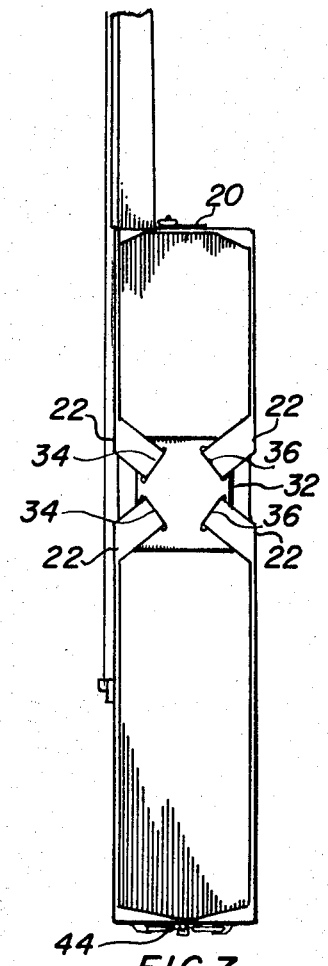
FIG. 7 is a side view of the instrument and invention taken along lines 7—7 of FIG. 1.

Another embodiment of the fixed retainer is shown in FIG. 4 and utilizes two continuous straps penetrating the retainer 20 through appropriate located slots near the corner. The straps 22 are preferably leather but may be of the same substance as the fixed retainer 20. A top hook receptacle 26 is attached in the upper quadrant of the retainer 20 and is in the form of a dee ring. This receptacle 26 is attached to the retainer 20 with flexible material 28 similar to the retainer 20 looping over the ring and attaching with fastenings means 30. The straps 22 are positioned on the instrument on both the top and the bottom shown in FIGS. 1 and 2 starting from the retainer 20 crossing over the top of the sounding board and bottom to the radiused recess or narrowest portion of the instrument body substantially in the middle. The straps follow the contour of the surface and abruptly bend approximately 90° to the side crossing over, in crisscross fashion, at the intermediate point through a semi-rigid rectangular crossover positioning member 32, one located on each side, best illustrated in FIG. 6 and 7. The crossover member 32 is substantially rectangular in shape with four slots 34 and 36 in each member. These slots are geometrically located at right angles to the corners and are of a size to accommodate the straps 22. The straps 22 slideably penetrate the slots 34 and crossover in the middle emerging at the mating slot 36 on the opposite side. The material of the crossover positioning member 32 is semi-rigid of the same substance as the fixed retainer 20.

Figure 9:
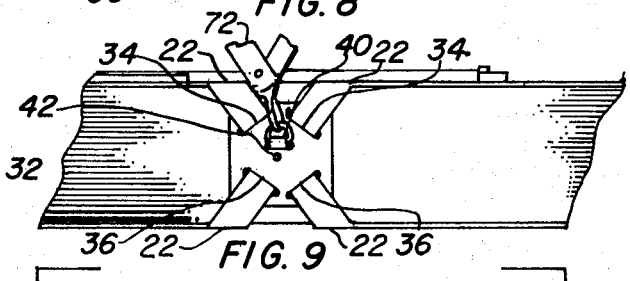
FIG. 9 is a partial side view of the invention in another embodiment with a loop strap side attachment taken along lines 9—9 of FIG. 10 rotated 90°.
Figure 10:
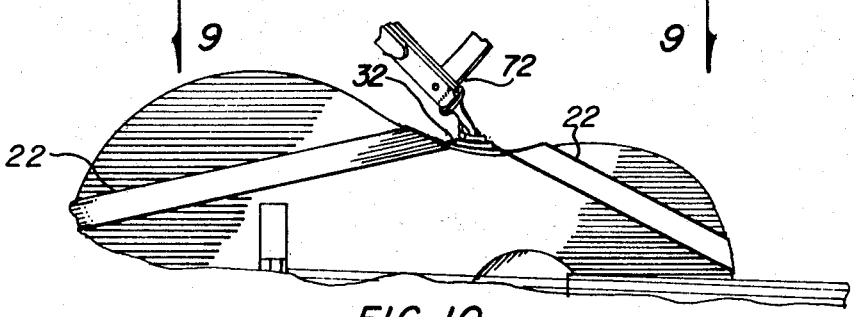
FIG. 10 is a partial plan view of the top of a stringed instrument including the invention with the embodiment containing a single attaching loop strap.

A single loop strap embodiment is shown in FIGS. 9 and 10 with the upper crossover positioning member 32 containing a middle hook receptable 38 located near the center of the rectangular member 32. The receptable 38 is also in the form of a dee ring and is attached in like manner to the member 32 of flexible material looping over the ring 40 and attached with fastening means 42 such as rivet.

Figure 3:
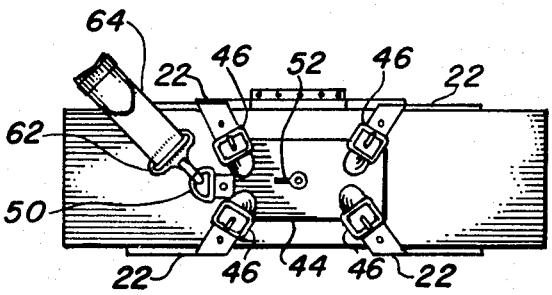
FIG. 3 is a view of the end of the instrument and invention taken along line 3—3 of FIG. 1.
Figure 8:
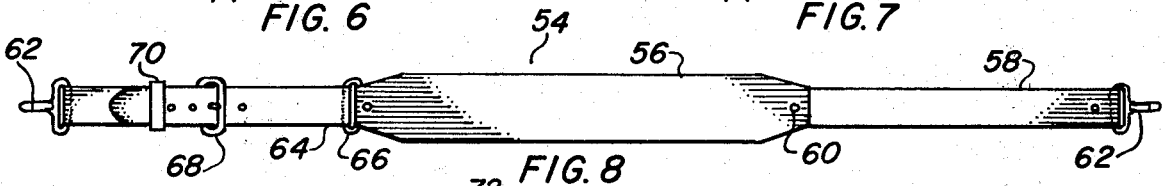
FIG. 8 is a view of the double end connecting neck strap removed from the harness and laid flat.

The straps 22, upon leaving the penetrations 34 and 36 in the member 32, continue along the surface of the instrument to the end opposite the fret handle. The straps 22 are then attached at their terminating point to a rectangular connecting retainer 44 best shown in FIG. 3. The retainer 44 allows a plurality of connecters 46, at least four, in the form of buckles, slides or the like to which the straps are connected. The connectors 46 are attached to the retainer 44 with flexible material 48 both being similar in configuration and material of those found on the retainer 20. The buckles 46 are located stragetically in the proximity of the corners of the connecting retainer 44. The retainer 44 also contains a bottom hook receptable 50 formed as a dee ring attached in like manner and material. The straps 22 are completely adjustable to the shape of the instrument and being buckled at the end the shape of the instrument is of little consequence as the harness completely surrounds the device top and bottom. The slotted hole 52 is provided in the retainer 44 through which a resilient bumper may penetrate if the instrument is so equipped. A neck strap 54 of the same material as the retainer 20 is shown flattened and separate from the harness in FIG. 8 and is also depicted attached in FIG. 1.

The double end connecting neck strap 54 may be any convenient width either plain or with ornamentation or resilient padding. The strap 54 is adjustable in length to permit the musician to locate the instrument in a confortable position. In the preferred embodiment the strap consists of three pieces attached together. The center member 56 is somewhat wider than the remaining members and has a strap 58 attached on one end with a rivet 60 or other fastening means and is looped through and riveted to a metallic spring snap fastener 62 or other similar device on the opposite end.

On the other end of the center member 56 is an adjustable strap 64 connected through a rectangular wire loop 66 retained by the center member on one side by overlapping and connecting by riveting or the like. The adjustable strap 64 is retained within the wire loop 66 on one end and through a spring strap fastener 62 on the other. The adjustable loop is completed through the use of a center bar buckle 64 or slide fastener held in place with rivets or the like and the loose end is held in place with a belt keeper 70. The strap 56 is attached to the harness by the dee rings 26 and 50 provided in the fixed retainer 20 and the connecting retainer 44 at the opposite ends of the instrument body in the preferred embodiment.

Figure 15:
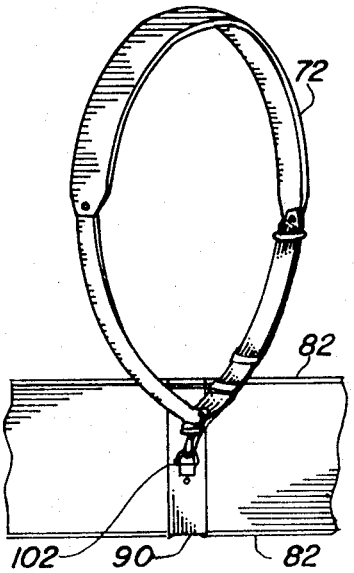
FIG. 15 is a isometric perspective view of a neck strap embodiment in single loop form with one fastener attached to the side slide through fastener.

In the single loop strap embodiment illustrated in FIGS. 9, 10 and 15 the strap 72 is attached to the dee ring 38 provided in the member 32 at the side of the instrument in the proximity of the crossover. These straps are plain or contain decoration in the form of an embossed design, materials added to the exterior surface or ornamental cap rings, studs, etc. The outside surface of the harness is juxtaposed on the sounding board of the instrument is particularly well adapted to receive indicia in the form of the owners name, musical group or similar markings.

Figure 11:
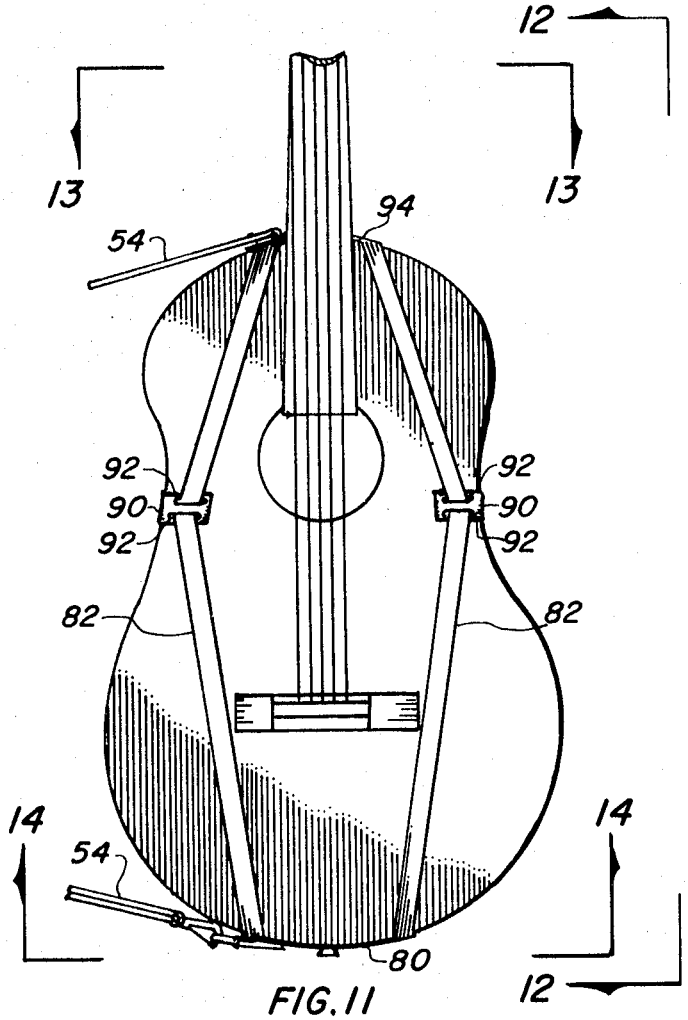
FIG. 11 is a partial plan view of the top of the stringed musical instrument in an embodiment with top slide through fasteners attached thereto.
Figure 12:
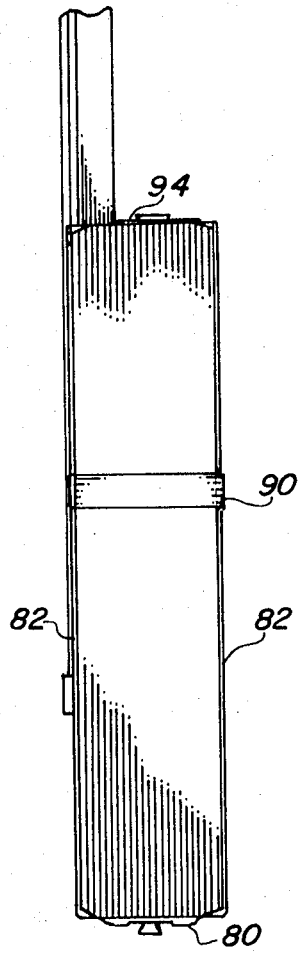
FIG. 12 is a side view of the above embodiment taken along lines 12—12 of FIG. 11.
Figure 13:
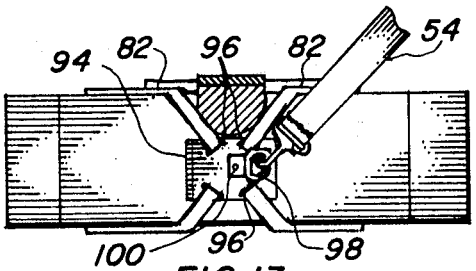
FIG. 13 is a partial view of the end of the above embodiment taken along lines 13—13 of FIG. 11 rotated 180°.
Figure 14:
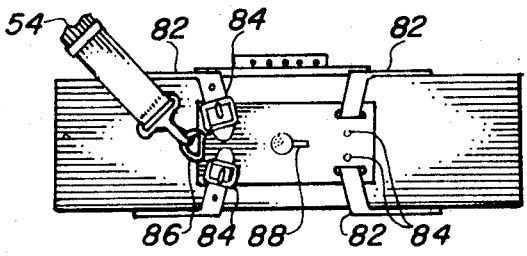
FIG. 14 is an end view of the above embodiment taken along lines 14—14 of FIG. 11.

A top and bottom surface connected embodiment is depicted in FIGS. 11 through 15 and differs only in the area of attachment of the crossover positioning member 32 in that it does not crossover but remains on the prime surface and is slideably attached. FIG. 11 best illustrates this embodiment with a rectangular connecting retainer 80 containing two flexible straps 82 that are attached in the corners with fastening means 84. The fastening means 84 may consist of stitching with thread, adhesive bonding, with riveting being preferred. The retainer 80 further contains a pair of connectors 84 in the form of buckles, slides or the like providing an attachment point for the termination of the straps 82. A bottom hook receptacle 86 is attached onto the retainer 80 at the side opposite the fastened straps 82. Also a slotted hole 88 is provided in the retainer 80 through which a resilient bumper may penetrate if the instrument is so equiped.

The straps 82 leave the retainer 80 and follow the surface of the instrument and bend abruptly along the flat surface top and bottom until they intersect with a slideable positioning member 90. This positioning member 90, located on each side of the instrument at the narrowest point, is rectangular in shape with 4 slots 92 near the ends. The straps 82 penetrate the slots 92 and hold them in place on the surface of th instrument sounding board. The straps continue along the surface until they reach the fret handle where they abruptly bend 90° and penetrate a rectangular slideable retainer 94 in criss-cross fashion. This retainer 94 is substantially rectangular in shape with 4 slots 96 geometrically located at right angles to the corners of a size to accomodate the straps 82. The straps 82 slideably penetrate the slots 96 and crossover in the middle emerging at the mating slot at the opposite side. The retainer 94 also contains a top hook receptacle 98 attached in the outer end and is in the form of a dee ring. This receptacle 98 is attached to the retainer with flexible material looping over the ring and attaching with fastening means 100.

The top and bottom surface connected embodiment also employs a double end connecting strap 54 connected to the dee rings 86 and 98 or a single loop neck strap 72 in a dee ring 102 similarly affixed to the upper positioning member 90 as in the preferred embodiment.

The material for the strapping arrangement in this embodiment is the same as described in the fixed retainer 20.

While the invention has been described in complete detail and pictorily shown in the accompanying drawings it is not to be limited in such detail since many changes and modifications may be in the invention without departing from the spirit and scope thereof hence it is described to cover any and all modifications and forms which may come within the language and scope of the appended claims.

I claim:

1. An adjustable harness with a neck retaining strap attached thereto for holding a stringed musical instrument having a sounding board, radiused middle recess and a fret handle at one end comprising:

(a) A rectangular fixed retainer positioned on said fret handle end of said instrument to which a top hook receptacle is attached and at least four flexible straps secured in the proximity of the corners of the fixed retainer;

(b) A plurality of semirigid rectangular crossover positioning members containing at least four geometrically related slots through which said flexible straps are slideably positioned in crisscross fashion;

(c) A rectangular connecting retainer having attached thereto a bottom hook receptacle and at least four adjustable connectors to receive and retain said straps;

(d) Whereby said harness is formed by the straps extending from said fixed retainer located on said musical instrument along the sounding board and bottom surface of the instrument from said fixed retainer and crossing over through said crossover positioning members at the radiused middle recess of the instrument and proceding on the opposite side of the instrument to said connecting retainer; whereby the instrument is retained by the harness; and (e) An adjustable neck strap connected on one end to said top hook receptacle of the rectangular fixed retainer and on the other end to said bottom hook receptacle of the connecting retainer to position the instrument on one's person.

2. The invention as recited in claim 1 further comprising: a middle hook receptacle attached to a slideable positioning member near its outside edge.

3. The invention according to claim 1 further comprising: said neck strap connected to said middle hook receptacle on said crossover positioning member to provide a loop to be directed around one's neck to hold said instrument.

4. An adjustable harness with a neck retaining strap attached thereto for holding a stringed musical instrument having a sounding board, radiused middle recess and a fret handle at one end comprising:

(a) A rectangular connecting retainer to which a bottom hook receptable is attached and at least two flexible straps secured in the proximity of two first adjacent corners and two adjustable connectors in the second adjacent corners;

(b) A plurality of slideable positioning members containing at least four related slots through which said flexible straps are slideably positioned;

(c) A rectangular slideable retainer having attached thereto a top hook receptable and four slots to receive and retain said straps in criss-cross fashion;

(d) Whereby said connecting retainer is positioned on the bottom end of said musical instrument with each strap positioned on the sounding board and bottom surface of the instrument and extending from said connecting retainer through said slideable positioning members at the radiused middle recess of the instrument and proceeding to said rectangular slideable retainer; crossing over and continuing in like manner terminating at said adjustable retainers whereby the instrument is retained by the harness; and (e) An adjustable neck strap connected on one end to said top hook receptacle of the rectangular slideable retainer and on the other end to said bottom hook receptacle of the connecting retainer to position the instrument on one's person.

5. The invention as recited in claim 4 further comprising: a dee ring attached to one of the slideable positioning members.

6. The invention according to claim 4 further comprising: a single loop neck strap connected to said dee ring on said slideable positioning member to provide a loop to be directed around one's neck to hold said instrument.

* * * * *